United States Patent [19]

Takezawa

[11] Patent Number: 4,539,546

[45] Date of Patent: Sep. 3, 1985

[54] SLIDING RHEOSTAT WITH SLIDER ELEMENT HAVING CALIBRATION MEANS

[75] Inventor: Keiji Takezawa, Miyagi, Japan

[73] Assignee: Alps Electric Co., Ltd., Japan

[21] Appl. No.: 605,597

[22] Filed: Apr. 30, 1984

[30] Foreign Application Priority Data

Apr. 28, 1983 [JP] Japan ..... 58-63092[U]

[51] Int. Cl.[3] ..... H01C 10/38; H01C 10/16; H01C 10/00

[52] U.S. Cl. ..... 338/176; 338/131; 338/135; 338/194

[58] Field of Search ..... 338/176, 184, 131, 135, 338/194, 202, 180

[56] References Cited

U.S. PATENT DOCUMENTS

| | | | |
|---|---|---|---|
| 3,337,831 | 8/1967 | Scott | 338/194 X |
| 3,510,821 | 5/1970 | Eberwein et al. | 338/131 X |
| 3,671,915 | 6/1972 | Sasaki et al. | 338/176 X |
| 3,883,840 | 5/1975 | Dornen et al. | 338/180 X |
| 4,126,846 | 11/1978 | Ueno et al. | 338/180 X |

FOREIGN PATENT DOCUMENTS

| | | | |
|---|---|---|---|
| 197807 | 11/1976 | Canada | 338/184 |
| 2019973 | 4/1971 | Fed. Rep. of Germany | 338/184 |

OTHER PUBLICATIONS

Mathews, "Positional Control Unit", IBM Tech. Disclosure, vol. 16, No. 8, Jan. 1974, p. 2493.

*Primary Examiner*—Roy N. Envall, Jr.
*Assistant Examiner*—C. N. Sears
*Attorney, Agent, or Firm*—Guy W. Shoup; Gerard F. Dunne

[57] ABSTRACT

A sliding rheostat includes two slider supports mounted to a support member between a pair of resistance base plates and in the direction that the slider supports move. Screws are mounted between the corresponding sliders and the support member to adjust the positions of the sliders relative to the support member, thus permitting the points at which the sliders are in contact with their respective resistance base plates to be placed in a line.

6 Claims, 3 Drawing Figures

SLIDING RHEOSTAT WITH SLIDER ELEMENT HAVING CALIBRATION MEANS

FIELD OF THE INVENTION

The present invention relates to a sliding rheostat for use in a studio mixer, or the like.

BACKGROUND OF THE INVENTION

Heretofore, rheostats for use in studio mixers have had a casing in which a pair of resistance base plates each having a resistance layer is disposed in an opposed and parallel relation. A slider support is disposed between the base plates, and the opposite surfaces of the support are provided with sliders which come into resilient contact with the respective base plates. Thus, the resistance value of the rheostat is varied by sliding the slider support.

In the aforementioned rheostat, the sliders which come into resilient contact with the respective base plates have been required to contact the resistance layer portions at areas providing the same resistance value. Accordingly, it is customary to adjust the positions of the sliders to eliminate any interlocking error. However, this adjusting operation is difficult to perform.

SUMMARY OF THE INVENTION

It is the main object of the present invention to provide a sliding rheostat which is free of the foregoing difficulty with the prior art device and which facilitates adjustment for eliminating any interlocking error.

This object is achieved in accordance with the present invention by providing a sliding rheostat which includes a casing and a pair of resistance base plates each having a resistance layer disposed disposed in a parallel and opposed relation in the casing. Sliders which may be brought into resilient contact with the respective base are held by slider supports disposed slidably between the base plates, and adjusting means are provided to adjust the positions of the sliders for placing the points, at which the sliders are in contact with the respective base plates, in a line.

DETAILED DESCRIPTION OF THE INVENTION

Figure 1:
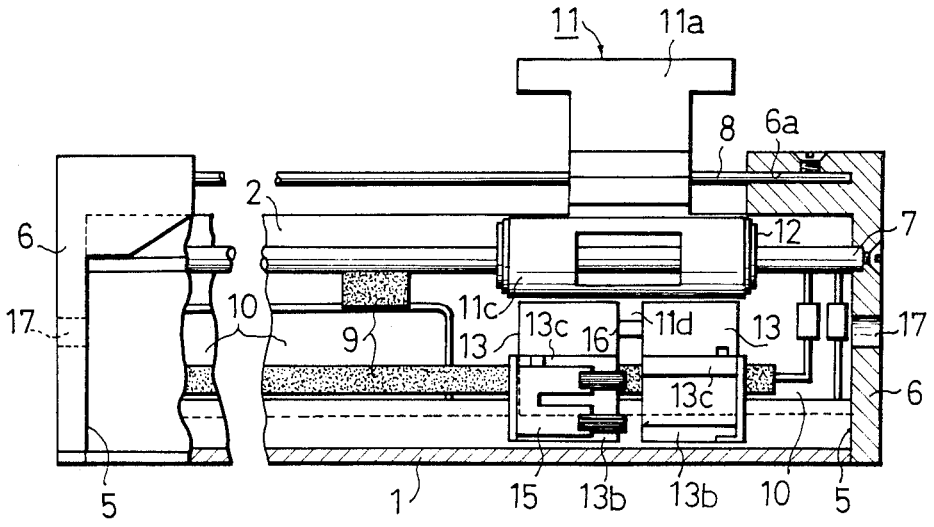
FIG. 1 is a front elevation in section of a sliding rheostat according to the present invention.
Figure 2:
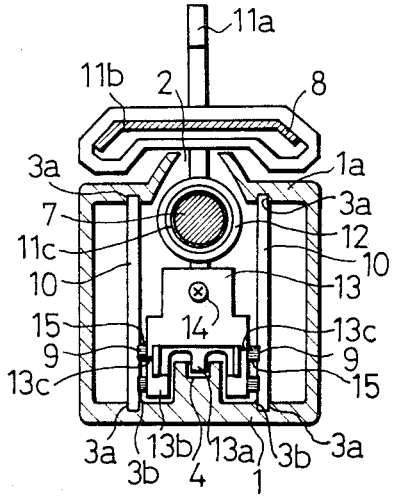
FIG. 2 is a side elevation in section of the rheostat shown in FIG. 1.

Referring to the drawing, there is shown a sliding rheostat embodying the concept of the present invention. The rheostat has a substantially convex casing 1 made of aluminum. The casing 1 is provided with an opening 2 at its upper end. The inner walls of the shoulder portions 1*a* of the casing are provided with grooves 3*a*. Similarly, the inner bottom walls are formed with grooves 3*a* opposite to the aforementioned grooves 3*a*. A recess 4 is formed substantially at the center of the bottom wall and is opposite to the opening 2. The ends of the casing 1 are each provided with an opening 5 to allow a support plate 6 constituting a portion of the casing 1 to be fitted thereto. A guide shaft 7 is securely fixed between the opposed support plates 6. The upper portion of each of the plates 6 is provided with a grooves 6*a*. A cover 8 serving to cover the opening 2 has end portions inserted in the grooves 6*a*, and a control lever (described later) is loosely held too the cover.

Resistance base plates 10 each made of insulating material are fitted in the respective grooves 3*a*, and each have a respective resistance layer 9. These plates 10 are disposed in the casing 1 in an opposed and parallel relation.

A control lever 11 produced from lead by die casting is disposed between the base plates 10. The lever 11 has a control portion 11*a* shaped like the letter "T" as viewed from a side, at the upper portion thereof. Formed below the control portion 11*a* is a guide hole 11*b*, in which the aforementioned cover 8 is loosely inserted. The opposite side portions of the hole 11*b* are somewhat bent downwards. A collar 12 made of synthetic resin is fitted to the lever 11 below the hole 11*b*. The lever is further provided with a hole 11*c* in which the guide shaft 7 is loosely inserted. A support member 11*d* is formed integrally with the lowermost portion of the lever 11. Slider supports 13 made of insulating synthetic resin are each movably attached to the support member 11*d* with screws 14 which constitute adjusting means. Each of the support 13 has a protrusion 13*a* extending from the bottom and slidably inserted in the recess 4. Small protrusions 3*b* are formed to define the grooves 3*a* described above such that lateral movement of leg portions 13*b* depending from the supports 13 on the opposite sides of the protrusion 13*a* is limited by the protrusions 3*b*. The sides of each support 13 are provided with anchoring portions 13*c* to anchor sliders (described later).

The two slider supports 13 are mounted to the support member 11*d* in the manner described above and extend in such a direction that the supports 13 may be slid in the longitudinal direction of the base plates 10. Sliders 15 shaped like the letter "U" are adapted to be brought into resilient contact with their respective base plates 10, and are fixedly secured to the opposite anchoring portions 13*c* on each support 13. The tips of each slider 15 are shaped like a brush and somewhat extend out from the slider supports 13. The sides of the support member 11*d* are provided with protruding elements 16 which engage with the slider supports 13 to hold the supports 13 with certainty.

Figure 3:
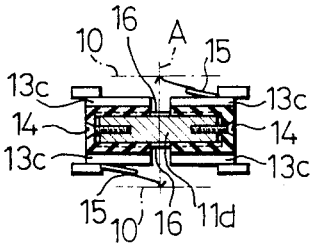
FIG. 3 is a top view in section of the support body of the rheostat shown in FIG. 1.

In the rheostat constructed as thus far described, when an adjustment is to be made to eliminate any interlocking error, the positions at which the screws 14 are screwed into the support member 11*d* are changed, and the slider supports 13 are slide relative to the support member 11*d*. This movement of the supports 13 shifts the sliders 15 fixed to the supports 13. Hence, an adjustment can be made to place the points, at which the sliders 15 are in contact with their respective base plates 10, in a line A, as shown in FIG. 3. This operation can be performed simply by adjusting one of the slider supports 13, but it is also possible to adjust both supports 13 if necessary.

The heads of the screws 14 are disposed in line with adjusting holes 17 which establish communication between the inside and outside of the casing 1. Thus, the screws 14 can be externally adjusted using a jig such as a driver.

As described hereinbefore, an improved rheostat has been provided in accordance with the invention, in which two slider supports are mounted to a support member, and means for adjusting the positions of the sliders relative to the support member are disposed between each slider and the support member, whereby any interlocking error can be easily eliminated with the adjusting means.

It is to be understood that the foregoing relates to only a preferred embodiment of the invention, and that it is intended to cover all changes and modifications of the example of invention herein chosen for the purposes of the disclosure, which do not constitute departures from the spirit and scope of the invention.

What is claimed is:

1. A sliding rheostat comprising:

a casing, a pair of resistance base plates each of which carries a respective resistance layer, the base plates being disposed in a parallel and opposed relation in the casing, sliders adapted to be brought into resilient contact with the respective base plates, two slider supports disposed between the base plates and adapted to be slid therealong, the sliders being mounted on the opposite surfaces of the slider supports, a support body for holding the slider supports, and adjusting means disposed between at least one of the slider supports and the support body for adjusting the positions of the sliders relative to the support body to align the sliders.

2. A sliding rheostat as set forth in claim 1, wherein the casing is provided with adjusting holes each of which gives an access to the inside of the casing such that the adjusting means can be adjusted from the outside of the casing.

3. A sliding rheostat as set forth in claim 1, wherein said support body is formed integrally with a control lever that is provided with a hole in which a guide shaft for sliding the sliders is loosely inserted.

4. A sliding rheostat as set forth in claim 3, wherein a collar made of synthetic resin is fitted in said hole in the control lever.

5. A rheostat including a pair of elongate resistance elements arranged in spaced-apart parallel relation and a slider adapted to be slid longitudinally between said resistance elements, said slider carrying two contact elements each adapted to be slid in contact with a respective resistance element upon longitudinal sliding movement of said slider, said contact elements each being secured to said slider by respective holders, and means adjusting the longitudinal position of said holders relative said slider so as to align said contact elements.

6. A rheostat according to claim 5, said means including a respective screw connecting each said holder to said slider; and said rheostat further including a casing having openings in wall portions thereof aligned with said screws for enabling the position of said holders to be adjusted by a tool inserted through said holes from the outside of said casing.

* * * * *